US006079808A

United States Patent [19]

Yamaguchi

[11] Patent Number: 6,079,808

[45] Date of Patent: Jun. 27, 2000

[54] INK JET RECORDING APPARATUS

[75] Inventor: Shuichi Yamaguchi, Nagano, Japan

[73] Assignee: Seiko Epson Corporation, Tokyo, Japan

[21] Appl. No.: 08/902,081

[22] Filed: Jul. 29, 1997

[30] Foreign Application Priority Data

Aug. 5, 1996 [JP] Japan ..... 8-221743

[51] Int. Cl.[7] ..... B41J 2/165

[52] U.S. Cl. ..... 347/30; 347/7; 347/23; 347/92

[58] Field of Search ..... 347/30, 7, 6, 23, 347/85, 86, 84, 92; 137/112, 512

[56] References Cited

U.S. PATENT DOCUMENTS

| | | | |
|---|---|---|---|
| 4,293,867 | 10/1981 | Isayama | 347/92 |
| 4,577,203 | 3/1986 | Kawamura . | |
| 5,216,450 | 6/1993 | Koitabashi et al. | 347/87 |
| 5,418,557 | 5/1995 | Pullen | 347/7 |
| 5,682,184 | 10/1997 | Stephany et al. | 347/7 |
| 5,757,395 | 5/1998 | Chew et al. | 347/24 |
| 5,764,253 | 6/1998 | Uchikata et al. | 347/23 |
| 5,875,615 | 3/1999 | Ito et al. | 53/474 |

FOREIGN PATENT DOCUMENTS 0609863 8/1994 European Pat. Off. .

0714778 6/1996 European Pat. Off. .

OTHER PUBLICATIONS

Patent Abstracts of Japan, vol. 006, No. 026, Feb. 16, 1982, JP 56 144162 A (Hitachi Ltd).

Patent Abstracts of Japan, vol. 014, No. 083, Feb. 16, 1990, JP 01 297259 A (Victor Co. of Japan, Ltd.).

*Primary Examiner*—N. Le
*Assistant Examiner*—Shih-Wen Hsieh
*Attorney, Agent, or Firm*—Sughrue, Mion, Zinn, Macpeak & Seas, PLLC

[57] ABSTRACT

An ink jet recording apparatus including an ink jet recording head 1 that is shuttled by a carriage 4 and jets ink droplets in synchronism with a print signal, a capping device 8 to which a negative pressure of a sucking pump 10 is supplied, a first ink tank 12 that communicates with the atmosphere through an opening 14 and contains a printing ink, a second ink tank 13 that contains ink in a degassed condition, a selector valve 16 that selectively connects the first and second ink tanks to the recording head, and a controller 20 that controls the selector valve 16. Ink in the first ink tank 12 or the second ink tank 13 is discharged out of the recording head 1 by causing the capping device 8 to apply negative pressure to the recording head 1 during a cleaning operation of the recording head 1.

10 Claims, 4 Drawing Sheets

INK JET RECORDING APPARATUS

BACKGROUND OF THE INVENTION

1. Field of the Invention

The present invention relates to ink jet recording apparatuses that print characters and patterns with a recording head to which ink is supplied from an ink tank. More particularly, the present invention is directed to an ink supply device.

2. Background Art

Ink jet recording apparatuses are designed to form dots on a recording medium by jetting ink droplets out of nozzle openings while supplying, from an ink tank, ink to pressure producing chambers that communicate with the nozzle openings and applying pressure to the pressure producing chambers so as to correspond to print data.

Since the ink jet recording apparatuses are designed to jet ink droplets by applying pressure to the pressure producing chambers, when bubbles enter into the pressure producing chambers, the pressure for jetting ink droplets is absorbed by the bubbles. As a result, the ink droplets cannot be jetted or the ink droplet flying speed is reduced, which in turn imposes the problem of impaired print quality and the like.

In order to overcome such problems, a cleaning operation is performed when the ink tank is replaced with a new one or when the print quality has been greatly impaired. That is, bubbles are removed by discharging the ink out of the recording head while sealing the recording head with a cap or the like and applying a negative pressure to the recording head from outside.

In order to remove the bubbles and maintain the print quality, the ink is usually contained in a degassed condition, and bubbles are caused to disappear by utilizing the high gas dissolubility of the degassed ink.

In order to maintain the degassed condition of the ink from factory shipment to the hands of users, the ink must be kept in a container made of a gas shielding material and, in addition, the container must be wrapped with a gas shielding film or the like. As a result, there exists a problem that the running cost of printing is elevated.

SUMMARY OF THE INVENTION

The present invention has been made in view of the aforementioned problems. The object of the present invention is, therefore, to provide an ink jet recording apparatus that can eliminate serious print defects caused by bubbles stagnant in the recording head using small amounts of degassed ink while using a nondegassed ink for printing and eliminating trivial print defects.

To overcome these problems, the present invention is applied to an ink jet recording apparatus that includes an ink jet recording head having nozzles for jetting ink droplets in synchronism with a print signal in a printing operation, and a carriage for shuttling the recording head back and forth; a cap that covers (seals) the nozzles in a cleaning operation of the recording head, and a sucking pump for supplying a negative pressure to the cap; a first ink tank that communicating with the atmosphere through an opening and containing a printing ink; a second ink tank containing ink in a degassed condition; a selector valve for selectively connecting the first and second ink tanks to the recording head; and a controller for controlling the selector valve, wherein the controller controls the selector valve so that one of the printing ink in the first ink tank and the ink in the degassed condition in the second ink tank is supplied to the recording head and discharged out of the nozzles of the recording head by the cap and the sucking pump during the cleaning operation of the recording head.

For printing and ordinary cleaning, an inexpensive ink contained in the first ink tank is used. For print defects that cannot be eliminated by the ordinary cleaning, a degassed ink in the second ink tank is used, so that bubbles stagnant in passages such as the recording head are discharged while dissolved in the degassed ink.

BRIEF DESCRIPTION OF THE DRAWING FIGURES

DETAILED DESCRIPTION OF THE PREFERRED EMBODIMENTS

Figure 1:
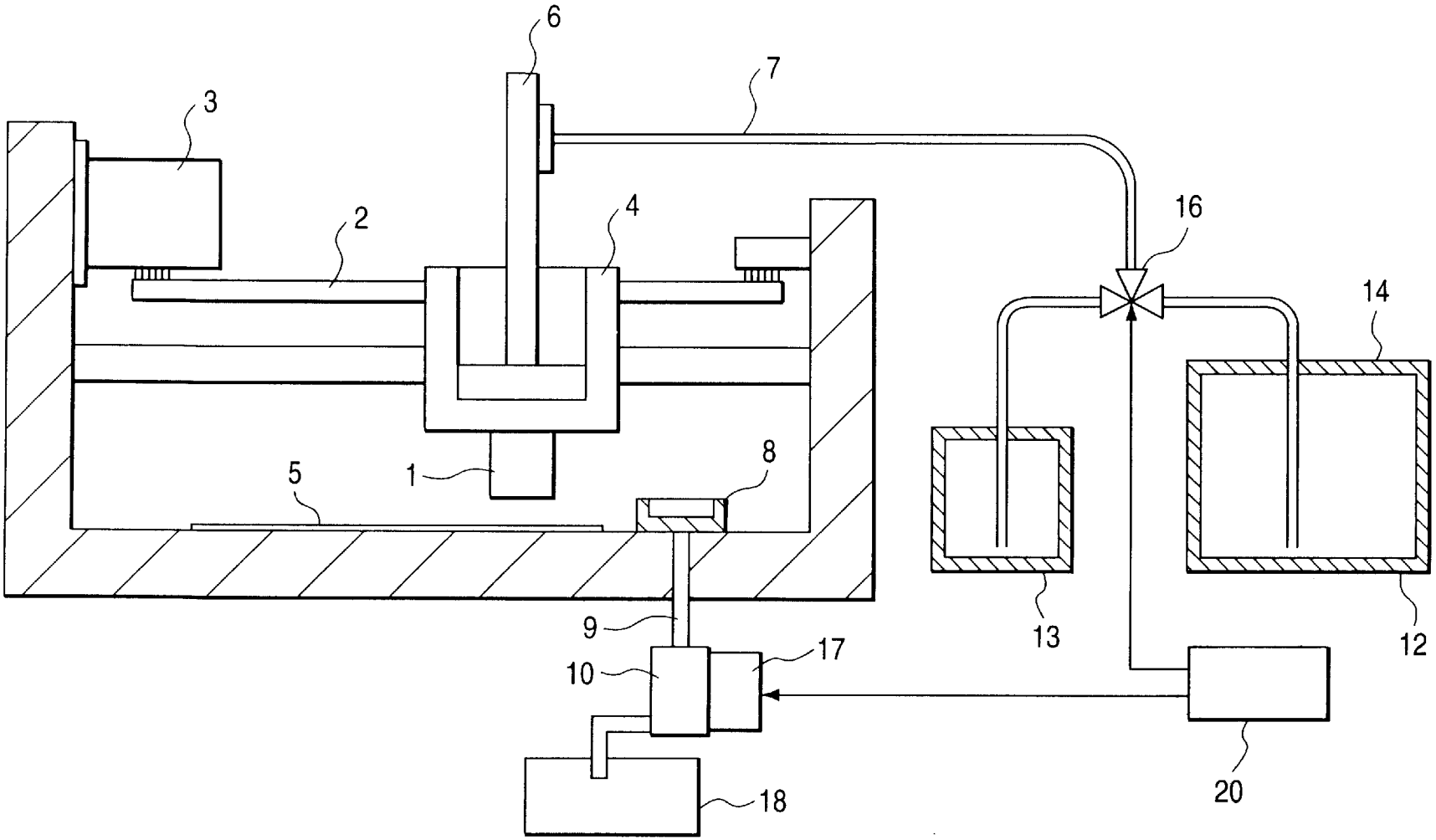
FIG. 1 is a diagram showing the construction of an ink jet recording apparatus according to an embodiment of the present invention.

Details of the present invention will now be described with the embodiments shown in the drawings.

FIG. 1 shows an embodiment of the present invention. In FIG. 1, reference numeral 1 denotes an ink jet recording head, which, as is well known, includes: pressure producing chambers that communicate with nozzle openings; and common ink chambers that supply ink to the pressure producing chambers. The ink jet recording head 1 is mounted on a carriage 4 that is connected to a carriage motor 3 through a timing belt 2, so that the ink jet recording head can shuttle across the width of a recording sheet 5.

The carriage 4 has a buffer tank 6 mounted thereon. The buffer tank 6 suppresses pressure fluctuations caused by movement of the carriage 4, and first receives ink in first or second ink tanks 12, 13, which will be described later, through a tube 7 and then supplies the received ink to the recording head 1.

Reference numeral 8 denotes a capping device that seals the surfaces of the nozzle openings of the recording head 1 to prevent the nozzle openings from clogging during the nonprinting period. The capping device 8 is connected to a sucking pump 10 through a tube 9, and has the function of forcibly discharging the ink out of the nozzle openings of the recording head 1 at the time of cleaning.

Reference numerals 12, 13 denote the aforementioned first and second ink tanks. The first ink tank 12 communicates with the atmosphere through an opening 14, and contains a nondegassed ink to be used for ordinary printing. Further, the second ink tank 13, whose capacity is set to a value smaller than that of the first ink tank 12, contains an ink that is degassed to about 50 to 90% of the pressure of saturated dissolved gases. The second ink tank 13 is designed to communicate with the atmosphere through, e.g., a capillary (not shown) so that the tank 13 can supply the ink to the recording head 1 while keeping such degassed condition of the ink to a highest possible extent.

These ink tanks 12, 13 are connected to the tube 7 through an electromagnetic three-way valve 16 that is controlled by a controller 20 that will be described later.

Reference numeral 17 in FIG. 1 denotes a motor that drives the sucking pump 10, and reference numeral 18 denotes a waste ink tank that contains ink discharged from the sucking pump 10.

Figure 2:
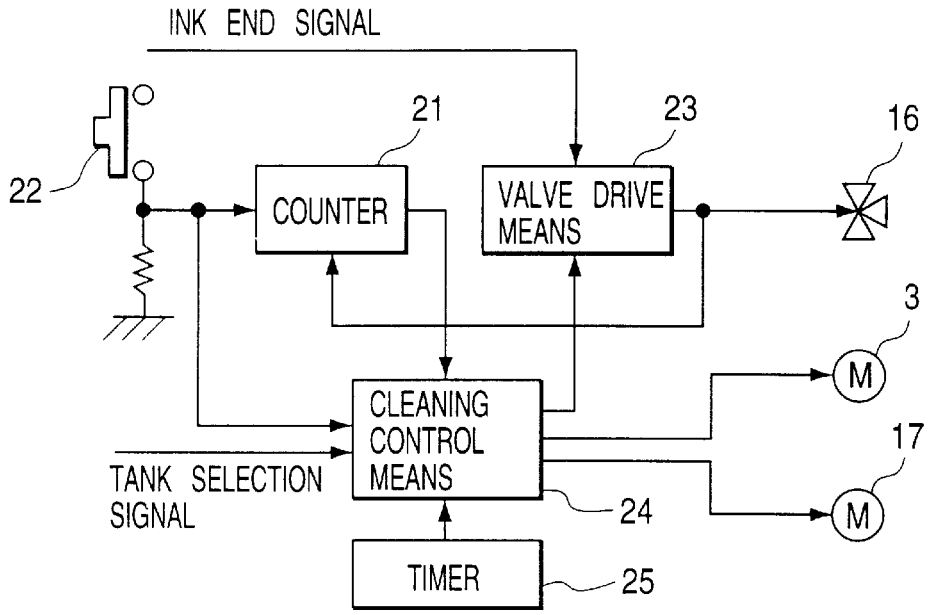
FIG. 2 is a block diagram showing a controller of the aforementioned recording apparatus.

FIG. 2 shows an embodiment of the controller 20. In FIG. 2, a cleaning counter 21 increments upon operation of a cleaning switch 22 after a predetermined time T0 has elapsed or when a predetermined amount of printing has been performed after the cleaning switch 22 was last pressed, and is reset when the cleaning operation has been performed using the ink in the second ink tank 13 or upon the elapse of the predetermined time T0.

Further, valve drive means 23 performs the operation of switching the selector valve 16 from the first ink tank 12 to the second ink tank 13 upon reception of an ink end signal outputted from a liquid level detecting means (not shown) disposed in the first ink tank 12, and also as a result of counting the quantity of ink that has been jetted out of the recording head 1 and discharged at the time of cleaning.

Reference numeral 24 denotes a cleaning control means, which moves the recording head 1 to the capping device 8 by controlling the motor 3 with a signal from the cleaning switch 22 to thereby cause the capping device 8 to seal the recording head 1. The cleaning control means 24 also operates the motor 17 for a predetermined time to thereby cause a negative pressure of the sucking pump 10 to be applied to the recording head 1, so that a predetermined amount of ink is forcibly discharged out of the recording head 1. The capping device 8 is then moved away from the recording head 1 after the ink has been discharged to thereby make the recording head 1 ready to print. At the time of discharging the ink, the cleaning counter 21 outputs a signal to the valve drive means 23 to switch the connection of the tube 7 between the first ink tank 12 and the second ink tank 13 through the selector valve 16 so that when the cleaning counter 21 is set to the default value, or "0" in this embodiment, the ink in the first ink tank 12 can be sucked and when the cleaning counter 21 is set to "2", the ink in the second ink tank 13 can be sucked.

Further, the cleaning control means 24 activates a timer 25 with a signal from a tank selection detector (not shown) that detects selection of the first ink tank 12, and switches the selector valve 16 at the time of charging the ink so that the degassed ink in the second ink tank 13 is used for a predetermined time T1; then the ink in the first ink tank is used for a predetermined time T2; and finally the ink in the second ink tank is used for a predetermined time T3.

A cleaning operation performed by the thus constructed apparatus will be described next with reference to the flowchart shown in FIG. 3.

Figure 3:
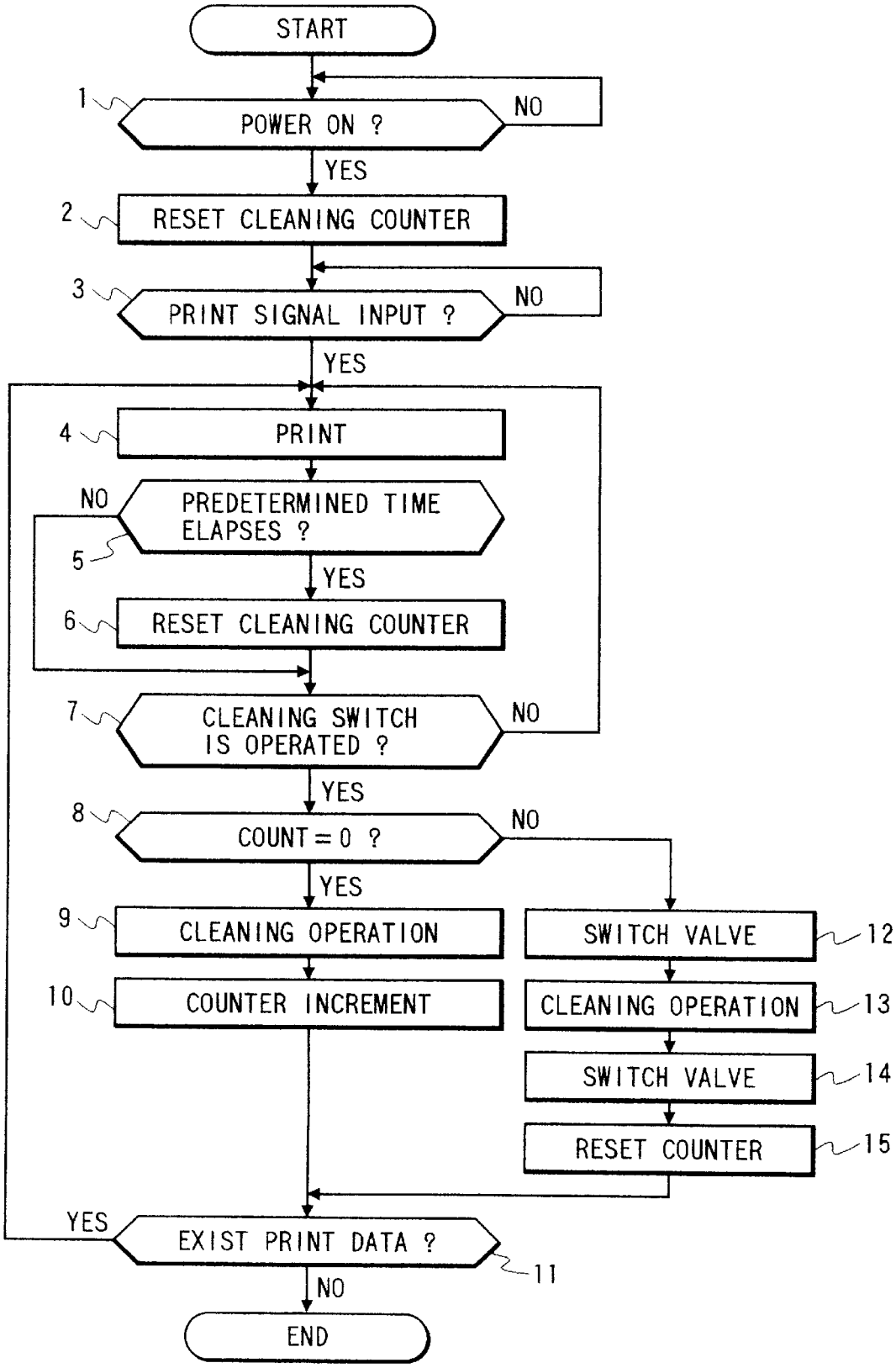
FIG. 3 is a flowchart showing a cleaning operation in a printing process performed by the aforementioned apparatus.

When a power switch (not shown) of the apparatus has been turned on (FIG. 3, Step 1), the cleaning counter 21 is reset (FIG. 3, Step 2) and waits for a print signal input (FIG. 3, Step 3).

When the print signal has been inputted so that the print operation is initiated (FIG. 3, Step 4), and when the predetermined time has elapsed, the cleaning counter 21 is reset (FIG. 3, Step 6).

On the other hand, when the cleaning switch 22 disposed on the casing has been operated by a user in the event of print trouble during the printing (FIG. 3, Step 7), the cleaning control means 24 checks the content of the cleaning counter 21, and when the counter 21 is set to "0" (FIG. 3, Step 8), the cleaning control means 24 stops printing, moves the recording head 1 to the capping device 8 to thereby cause the capping device 8 to seal the recording head 1, and operates the sucking pump 10 without operating the selector valve 16.

The recording head 1 discharges the ink supplied from the first ink tank 12 out of the nozzle openings with the negative pressure applied from the capping device 8, so that bubbles stagnant in the pressure producing chambers and the like in the recording head 1 are caused to discharge to the capping device 8 along with the stream of the ink (FIG. 3, Step 9).

The counter 21 is incremented upon the end of the cleaning operation (FIG. 3, Step 10), and if the print data is present, the operation in Step 4 is performed again to print the data. As a result of the above operation, less serious ink jet clogging can be eliminated by cleaning the nozzle openings with the ink in the first ink tank 12 that is less expensive, so that satisfactory ink jet performance can be recovered.

On the other hand, if print trouble occurs again within a short time after the cleaning operation with the ink in the first ink tank 12 has been completed, then the user operates the cleaning switch 22 (FIG. 3, Step 7) before the predetermined time elapses (FIG. 3, Step 5).

By operating the cleaning switch 22 within such a short time, the cleaning counter 21 is incremented to "2", (FIG. 3, Step 8) without clearing the last content.

The cleaning control means 24 switches and connects the tube 7 to the second ink tank 13 through the selector valve 16 (FIG. 3, Step 12), and drives the motor 17 to cause the negative pressure of the sucking pump 10 to be applied to the recording head 1. As a result, the degassed ink contained in the second ink tank 13 is introduced into the buffer tank 6 and the recording head 1 through the tube 7, so that bubbles stagnant in the buffer tank 6 and the recording head 1 are discharged to the capping device 8 (FIG. 3, Step 13).

The cleaning control means 24 stops the motor 17 to thereby end the cleaning operation when a time interval long enough to discharge the bubbles has elapsed, and switches the selector valve 16 to connect the tube 7 to the first ink tank 12 (FIG. 3, Step 14) and resets the counter 21 (FIG. 3, Step 15).

Thus, since the degassed ink is charged into the passages in the recording head 1 and the like immediately after the cleaning operation performed with the degassed ink in the second ink tank 13, even if bubbles that have been left undischarged by the cleaning operation are present, these bubbles are dissolved and lost into the degassed ink owing to the high gas dissolubility of the degassed ink.

Therefore, when the print operation is performed for the next time, the pressure applied for jetting ink droplets is applied to the ink, so that the print trouble can be eliminated reliably. If the print operation is continued (FIG. 3, Step 11), the inexpensive ink contained in the first ink tank 12 is supplied to the recording head 1.

Figure 4:
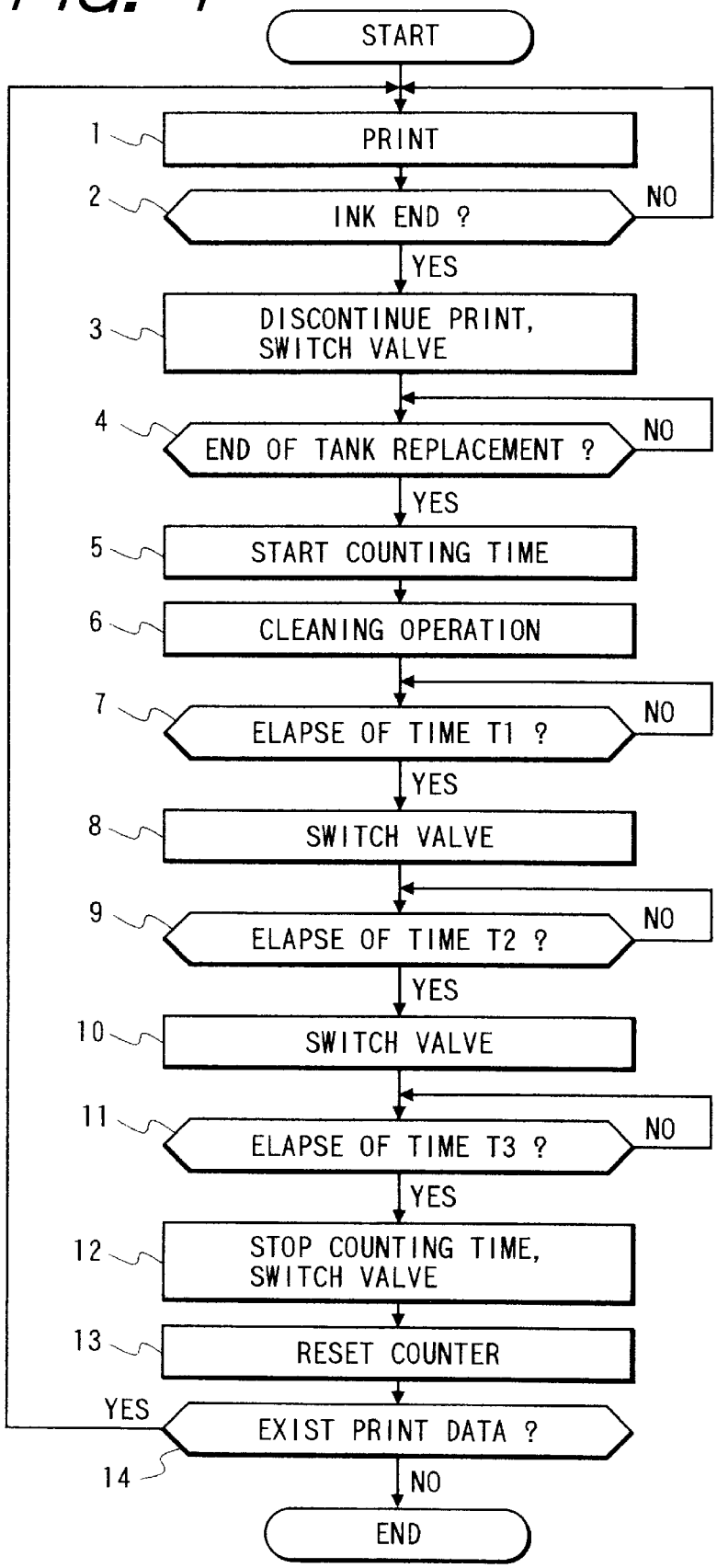
FIG. 4 is a flowchart showing a cleaning operation at the time of replacing ink tanks in the aforementioned apparatus.

When the print operation is continued in this way (FIG. 4, Step 1), and when an ink end signal has been inputted as a result of the ink in the first ink tank 12 having been consumed (FIG. 4, Step 2), the cleaning control means 24 switches the selector valve 16 to the second ink tank 13 and supplies the ink in the second ink tank 13 to the recording head 1 to thereby allow the print operation to be continued (FIG. 4, Step 3). As a result, even if the ink in the first ink tank 12, which is the main ink tank, has run out, the print operation can be continued up to an appropriate place before stopping the printing operation.

When the print operation to the predetermined place using the ink in the second ink tank 13 has ended and the first ink tank 12 has thereafter been replaced with a new one (FIG. 4, Step 4), the timer 25 starts counting and the aforementioned cleaning operation is initiated (FIG. 4, Step 6).

That is, the recording head 1 is sealed by the capping device 8 and the negative pressure of the sucking pump 10 is applied to the recording head 1, so that the ink in the second ink tank 13 is sucked for the predetermined time T1 and the degassed ink is charged into the recording head 1. As a result, bubbles in the recording head 1 are discharged outside while dissolved into the degassed ink. Hence, the bubbles can be discharged swiftly.

Upon elapse of the time T1 (FIG. 4, Step 7), the cleaning control means 24 switches the selector valve 16 to the first ink tank 12, so that the ink in the first ink tank 12 is sucked by the recording head 1 (FIG. 4, Step 8). Since bubbles in the recording head 1 have disappeared while dissolved in the degassed ink as described above, the nondegassed ink in the first ink tank 12 flows into the recording head 1 with the likelihood of producing bubbles suppressed to a lowest possible degree, and the bubbles deposited on the connecting parts and the like at the time of replacing the tanks are discharged.

Upon elapse of the predetermined time T2 (FIG. 4, Step 9), the cleaning control means 24 switches the selector valve 16 again to the second ink tank 13 (FIG. 4, Step 10), and supplies the recording head 1 with the degassed ink for the predetermined time T3.

When the recording head 1 gets ready to print with the degassed ink charged thereinto, the timer 25 stops counting the time and the selector valve 16 is switched so that the first ink tank 12 is connected to the recording head 1 (FIG. 4, Step 12), and the counter 21 is reset (FIG. 4, Step 13), so that the recording head 1 is prepared to print (FIG. 4, Step 14).

While the first and second ink tanks are switched by the electromagnetic three-way valve in the aforementioned embodiment, it is apparent that similar advantages can be obtained by using another switching device that is driven by a motor or the like, such as a rotary valve.

Further, while the selector valve is operated by a signal from the controller 20 in the aforementioned embodiment, the two ink tanks can also be switched by controlling the negative pressure applied to the tube 7 while changing the rotational speed of the motor 17 that drives the sucking pump 10.

Figure 5:
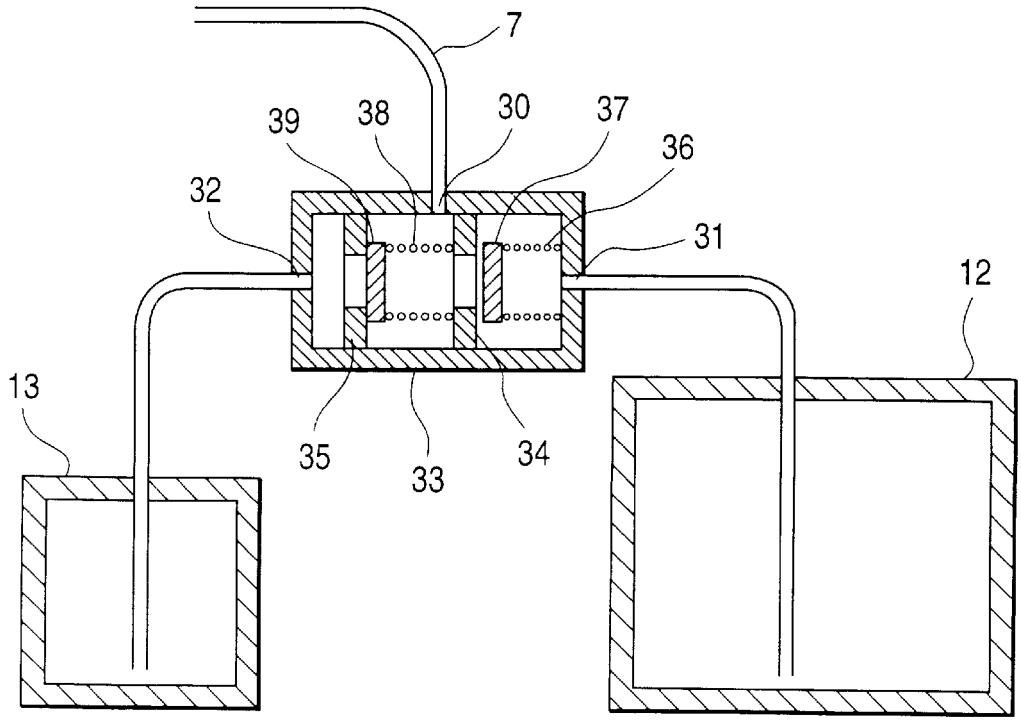
FIG. 5 is a diagram showing another embodiment of a selector valve adapted for the aforementioned apparatus.

FIG. 5 shows an embodiment of such a selector valve that can switch passages by the negative pressure. This selector valve is constructed of a casing body 33 that has a discharge port 30 in the middle thereof and first and second flow ports 31, 32 on both sides thereof. The discharge port 30 is connected to the tube 7, and the first and second flow ports 31, 32 communicate with the first and second ink tanks 12, 13. First and second valve seats 34, 35 are formed for the first flow port 31 and the discharge port 30 and for the second flow port 32 and the discharge port 30, respectively. A first valve body 37 is disposed on the first valve seat 34 while having a predetermined clearance with respect to the first valve seat 34, the first valve body 37 receiving an urging force of a spring 36 so that the first valve body 37 abuts against the valve seat 34 with a strong sucking force applied by the sucking pump 10. A second valve body 39 is disposed on the second valve seat 35, the second valve body 39 normally abutting against the valve seat 35 and receiving an urging force of a spring 38 so that the second valve body 39 moves away from the valve seat 35 with the strong sucking force applied by the sucking pump 10.

In this embodiment, if the negative pressure is applied to the tube 7 as in the case of printing or if the negative pressure of the sucking pump 10 is weak, the first valve body 37 moves away from the first valve seat 34 and the second valve body 39 abuts against the valve seat 35. Therefore, the first ink tank 12 is connected to the recording head 1, so that the recording head 1 can be supplied with the ink in the first ink tank 12 with the likelihood of producing bubbles being suppressed as much as possible.

On the other hand, if a strong negative pressure is applied to the tube 7 during cleaning, the first valve body 37 is caused to abut against the valve seat 34 by such negative pressure while resisting the force of the spring 36 and thereby shuts the passage, and the second valve body 39 moves away from the second valve seat 35 while resisting the force of the spring 38 and thereby opens the passage. As a result, the recording head 1 can be supplied with the degassed ink in the second ink tank 13 in which bubbles are quite hard to produce.

While the inks are discharged by applying a negative pressure in the aforementioned embodiments, the inks may be discharged by applying a signal for jetting an ink droplet such as a print signal.

As described above, the inexpensive ink contained in the first ink tank is used for printing and ordinary cleaning so that running costs can be controlled, and cleaning with the ink in the second ink tank is implemented for print trouble that cannot be eliminated by the ordinary cleaning, so that bubbles in the recording head and passages can be discharged outside swiftly while dissolved in the ink owing to the high gas dissolubility of the degassed ink in the second ink tank, allowing the print trouble to be eliminated reliably within a short period of time.

What is claimed is:

1. An ink jet recording apparatus comprising:

an ink jet recording head having nozzles for jetting ink droplets in synchronism with a print signal in a printing operation, and a carriage for shuttling the recording head back and forth;

a cap that covers the nozzles in a cleaning operation of the recording head, and a sucking pump for supplying a negative pressure to the cap;

a first ink tank communicating with the atmosphere through an opening and containing a printing ink;

a second ink tank containing ink in a degassed condition;

a selector valve for selectively connecting the first or second ink tank to the recording head; and a controller for controlling the selector valve, wherein the controller controls the selector valve so that one of the printing ink in the first ink tank and the ink in the degassed condition in the second ink tank is supplied to the recording head and discharged out of the nozzles of the recording head by the cap and the sucking pump during the cleaning operation of the recording head.

2. An ink jet recording apparatus according to claim 1, wherein the controller performs a counting operation upon receiving a cleaning instruction, and the counting operation is reset after either a predetermined time has elapsed or a predetermined amount of printing has been performed since a previous counting operation, and the controller switches the selector valve from the first ink tank to the second ink tank when the counting operation reaches a predetermined value.

3. An ink jet recording apparatus according to claim 1, wherein the controller controls the selector valve to connect the second ink tank to the recording head when the printing ink in the first ink tank is insufficient.

4. An ink jet recording apparatus according to claim 3, wherein the printing operation is continued with ink from the second ink tank up to a predetermined stopping point.

5. An ink jet recording apparatus according to claim 1, wherein when the first ink tank is replaced after the printing ink in the first ink tank is consumed, the controller controls the selector valve to connect the second ink tank to the recording head, and then to connect the first ink tank to the recording head at time T1, and then to connect the second ink tank to the recording head at time T2, and then to connect the first ink tank to the recording head at time T3.

6. An ink jet recording apparatus according to claim 1, wherein a capacity of the first ink tank is larger than a capacity of the second ink tank.

7. An ink jet recording apparatus comprising:

an ink jet recording head having nozzles for jetting ink droplets in synchronism with a print signal in a printing operation, and a carriage for shuttling the recording head back and forth;

a cap that covers the nozzles in a cleaning operation of the recording head, and a sucking pump for supplying a negative pressure to the cap;

a first ink tank communicating with the atmosphere through an opening and containing a printing ink;

a second ink tank containing ink in a degassed condition; and a selector valve for selectively connecting the first or second ink tank to the recording head, wherein negative pressure is applied to the selector during the printing operation and during the cleaning operation, the negative pressure applied during the cleaning operation being stronger than the negative pressure applied during the printing operation, and wherein the selector valve communicates the first ink tank with the recording head during the printing operation, and wherein the selector valve communicates the second ink tank with the recording head during the cleaning operation.

8. An ink jet recording apparatus according to claim 7, further comprising a controller that performs a counting operation upon receiving a cleaning instruction, wherein the counting operation is reset after either a predetermined time has elapsed or a predetermined amount of printing has been performed since a previous counting operation, and wherein the controller controls the sucking pump to increase a sucking force of the sucking pump when the counting operation reaches a predetermined value, in order to switch the selector valve to connect the second ink tank with the recording head.

9. An ink jet recording apparatus according to claim 7, wherein a capacity of the first ink tank is larger than a capacity of the second ink tank.

10. An ink jet recording apparatus according to claim 7, wherein the selector valve comprises:

a casing body having a discharge port that communicates with the recording head, and first and second flow ports that communicate with the first and second ink tanks, respectively;

a first valve seat for the first flow port and the discharge port, and a second valve seat for the second flow port and the discharge port;

a first valve body supported in the casing body by a first spring with a predetermined clearance with respect to the first valve seat, wherein the first valve body abuts against the first valve seat when a sucking force applied by the sucking pump is greater than a counter force applied by the first spring;

a second valve body supported in the casing body by a second spring, the second spring urging the second valve body toward the second valve seat to normally abut against the second valve seat, wherein the second valve body is moved out of contact with the second valve seat by the same sucking force that causes the first valve body to abut against the first valve seat.

* * * * *